US008721308B2

(12) United States Patent
Shiinoki et al.

(10) Patent No.: US 8,721,308 B2
(45) **Date of Patent: *May 13, 2014**

(54) WATER INJECTED SCROLL AIR COMPRESSOR

(75) Inventors: Kazuaki Shiinoki, Yokohama (JP); Natsuki Kawabata, Shizuoka (JP); Hirotaka Kameya, Rifu (JP)

(73) Assignee: Hitachi Industrial Equipment Sytems Co., Ltd., Tokyo (JP)

( * ) Notice: Subject to any disclaimer, the term of this patent is extended or adjusted under 35 U.S.C. 154(b) by 355 days.

This patent is subject to a terminal disclaimer.

(21) Appl. No.: 13/025,460

(22) Filed: Feb. 11, 2011

(65) Prior Publication Data

US 2011/0274574 A1 Nov. 10, 2011

(30) Foreign Application Priority Data

May 10, 2010 (JP) ..... 2010-107855

(51) Int. Cl.
*F01C 1/02* (2006.01)

(52) U.S. Cl.
USPC ..... 418/55.1; 418/55.6

(58) Field of Classification Search
USPC ..... 418/55.1, 55.6; 417/44.1; 123/559.1
See application file for complete search history.

(56) References Cited

U.S. PATENT DOCUMENTS 6,450,791 B1 * 9/2002 Kawabata et al. ..... 418/55.1
6,616,415 B1 * 9/2003 Renken et al. ..... 417/44.1
8,202,057 B2 * 6/2012 Kohsokabe et al. ..... 417/13

FOREIGN PATENT DOCUMENTS

JP 8-128395 A 5/1996
JP 2009-180099 A 8/2009
JP 2010-144709 A 7/2010

OTHER PUBLICATIONS

U.S. Appl. No. 13/024,123, filed Feb. 9, 2011.
Yanagisawa et al., Performance of oil-free scroll-type air compressors. Institute of Mechanical Engineers (IMechE). Department of Mechanical Engineering, Shizuoka University, Japan. 1995, pp. 279-287. C542/088/99.

* cited by examiner

*Primary Examiner* — Thai Ba Trieu
*Assistant Examiner* — Thomas Olszewski
(74) *Attorney, Agent, or Firm* — Crowell & Moring LLP

(57) ABSTRACT

As pressure in a water tank rapidly rises when water inside a compressor is evaporated by the high temperature of compressed air and this situation makes the operation unstable, an object of the present subject matter is to address this problem. A water injected scroll air compressor is provided with: an air end of the scroll air compressor; a driving unit that generates driving force for the air end; a compressing path from a suction port to a discharge port; a portion to inject water into the compressing path; a discharge piping of air discharged from the air end; a tank provided on a path of the discharge piping for storing water separated from the compressed air; and a cooler that is provided on the path of the discharge piping between the tank and the air end and cools the compressed air discharged from the air end.

12 Claims, 3 Drawing Sheets

WATER INJECTED SCROLL AIR COMPRESSOR

This application claims the priority of Japanese Patent Application No. JP 2010-107855, filed May 10, 2010, the disclosure of which is expressly incorporated by reference herein in its entirety.

TECHNICAL FIELD

This subject matter relates to a scroll air compressor that compresses air, particularly relates to a water injected scroll air compressor of a type that water is injected into compression chamber.

BACKGROUND

For a portion to enhance the energy efficiency of an air compressor for general industry, an oil injected type and a water injected type that mix oil or water with air sucked inside an air end and compress them together are known.

The oil and the water have effect that they seal narrow clearance via which compression chamber connects with another space and reduce inside leakage and effect that they absorb the heat of compression and prevent the thermic deformation of members of the compressor, reducing compressing power and the energy efficiency is enhanced with both effects.

The oil injected type excels in reliability because it has longtime achievements, however, as it is feared that a component of oil may remain in supplied discharged air though the component of oil is extremely slight, the oil injected type cannot be used for application in which even the existence of a minute oil content is not allowed such as food and a semiconductor. According to the water injected type, supplied air includes no oil content, however, as a countermeasure against rust, corrosion, the failure of lubrication and others is required, the prevalence has retarded, compared with the oil injected type.

However, the development of a water injected air compressor has been recently popular because of a request of a market for clean air that includes no oil content and a screw air compressor is disclosed in Japanese Patent Application Laid-Open Publication No. 2009-180099 which is a first well-known example.

The adoption of a water injected type scroll air compressor is disclosed in Japanese Patent Application Laid-Open Publication No. H8-128395 which is a second well-known example. Besides, results of experiments in which efficiency is enhanced by injecting water into a scroll air compressor are described in "Performance of oil-free scroll-type air compressors" written by T. Yanagisawa, M. Fukuta, and Y. Ogi (Shizuoka University) in Proceedings of International Conference on Compressors and Their Systems as an identification number of IMechE 1999 C542/088, issued in September, 1999 and published by Institution of Mechanical Engineers (IMechE), which is a third well-known example.

SUMMARY

However, in the above-mentioned well-known examples, no portion to address problems such as rust and corrosion caused by water when the water is injected into the compressor and the compression of liquid and to operate, maintaining longtime reliability is described. Particularly, the adoption of the water injected type oil-free scroll air compressor has following three problems and its product planning does not progress, compared with a screw compressor.

(1) As an aluminum alloy the density of which is small and which is excellent in thermal conductivity is used for the material of a scroll because of a dimensional constraint of a balance weight to balance with eccentric mass in orbiting and a characteristic of outgoing radiation, the corrosion of the material when water is injected is worried.

(2) As compression chamber radially moves toward the center from the periphery along a scroll wrap, reducing a radius, injected water itself causes uncertain unbalance and the increase of vibration and noise is worried.

(3) The strength of the wrap in the center in which pressure and temperature are high does not have sufficient tolerance and when injected water is compressed, the wrap may be damaged.

Problems to be particularly addressed by the present subject matter in the above-mentioned background are as follows.

(4) When water remains in the compression chamber in activation, excessive torque by the compression of liquid causes the failure of activation, the scroll wraps are touched because of a thermal transient condition, and vibration increases because unbalance is caused.

(5) When water remains in the compression chamber in a stop, an orbiting scroll and a fixed scroll respectively made of an aluminum alloy for example may be corroded.

(6) When water inside the compressor is evaporated because of the high temperature of compressed air, pressure in a water tank rapidly rises and the rapid rise causes stable operation. Besides, in the evaporation, a piping system, the tank and others may be damaged.

The present subject matter is made to address the above-mentioned some problems.

To address the above-mentioned problems, a water injected scroll air compressor according to the present subject matter is provided with: an air end equipped with an orbiting scroll member having a scroll wrap and a fixed scroll member having a substantial scroll wrap corresponding to the wrap of the orbiting scroll member; a driving unit that generates driving force for making the orbiting scroll member orbit the fixed scroll member; a compressing path from a suction port to a discharge port; a portion to inject water into the compressing path; a discharge piping of air discharged from the air end; a tank which is provided on a path of the discharge piping and which stores water separated from compressed air; and a cooler which is provided on the path of the discharge piping between the tank and the air end and which cools the compressed air discharged from the air end.

In the scroll air compressor according to the present subject matter, more suitable examples are as follows.

(1) The operation is controlled by switching operation in which water is injected into the compressing path and operation in which no water is injected.

(2) The cooler cools air discharged from the air end in operation without water injection and cools mixed fluid discharged from the air end of air and water in operation with water injection.

(3) The mixed fluid cooled in the cooler of air and water is separated on the downstream side of the cooler.

(4) The tank is a separator tank that can separate into the air and the water.

(5) The air end is provided with total two compressing mechanisms each of which is configured by the orbiting scroll and each fixed scroll, the scroll wraps of the orbiting scroll of both mechanisms are formed back to back with the same member, the orbiting scroll member is driven by two eccentric shafts provided outside the periphery of the wrap and rotated with the shafts synchronous, the eccentric shaft is substantially horizontally arranged, and against thermic deformation and deformation by gas pressure in operation without water injection, clearance between the wraps of the orbiting scroll and the fixed scroll is formed to prevent the wraps from being mutually touched.

(6) The materials of orbiting scroll and the fixed scroll are made of an aluminum alloy.

According to the present subject matter, as moisture left in the compression chamber can be removed by suitably executing operation without water injection, the failure by injection of activation is prevented and a problem that the material of the scroll is corroded in a stop can be avoided. Further, as a decrease by evaporation in operation without water injection of water stored in the water separator tank and the rapid rise of pressure in the water separator tank can be prevented, the stable operation of the compressor is enabled.

BRIEF DESCRIPTION OF THE DRAWINGS

The present subject matter will become fully understood from the detailed description given hereinafter and the accompanying drawings, wherein.

DETAILED DESCRIPTION

Figure 1:
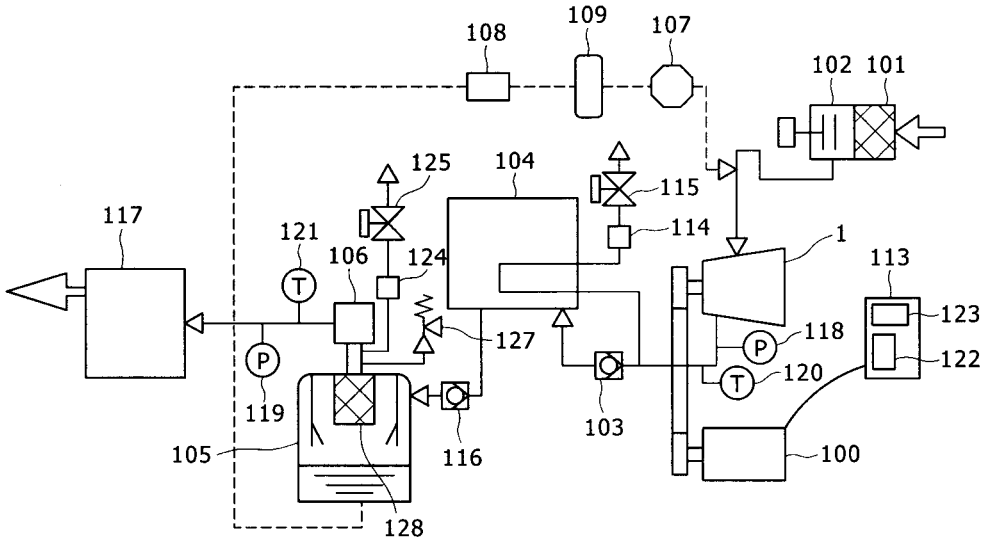
FIG. 1 is a block diagram showing a scroll air compressor in an example of the present subject matter.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

A preferred example of the present subject matter is as follows. First, a scroll air compressor in this example is provided with: an orbiting scroll member equipped with a scroll wrap; a fixed scroll member equipped with a substantial scroll wrap corresponding to the wrap of the orbiting scroll member; a driving unit (a motor 100) that generates driving force for making the orbiting scroll member orbit the fixed scroll member; and a compressing path from a suction port to a discharge port, and adopts a method of injecting water into the compressing path.

In the concrete, as for activation, a method of initiating operation without injecting water (hereinafter called operation without water injection) and initiating the injection of water (hereinafter called operation with water injection) after certain time elapses since the initiation of the operation is adopted. As described later, the operation without water injection and the operation with water injection are suitably switched.

A portion to detect at least either of the temperature or the pressure of compressed gas discharged from the compressing path is provided to a control system and besides, in the control system, operation time is operated. The control is enabled with simple configuration by switching operation with water injection and operation without water injection according to these conditions.

For example, a suitable operational state can be realized by executing control described in following (1) to (5).

(1) At the same time that the motor is stopped, the injection of water is stopped or before the motor is stopped, operation without water injection that the injection of water is stopped is executed.

(2) The injection of water into the compressing path is stopped or reduced based upon a result of operation using at least one parameter of the pressure, the temperature and the operation time in the operation.

(3) Line pressure is detected, it is estimated based upon its value and the variation that the compressor is automatically stopped, and the injection of water is stopped before the compressor is stopped. At this time, the quantity of injected water may be also gradually reduced based upon the value of the pressure and the variation.

(4) When line pressure rapidly decreases contrary to the estimate in (3) and the compressor is not automatically stopped, operation with water injection is resumed based upon separately determined pressure or according to the elapse of time.

(5) When no external air vessel is provided and discharge pressure rapidly varies, the injection of water may be also ordinarily stopped.

Hereby, in a stop, no water is left in compression chamber and the corrosion of the material of a scroll and a problem in activation can be avoided. Particularly, when the material of the scroll is made of an aluminum alloy, the resistance to corrosion of the compressor is enhanced.

To realize more suitable control, it is desirable that a variable frequency drive is provided for the following reasons.

For example, when the injection of water is stopped during the operation of the compressor because of the rise of discharge pressure to be operation without water injection and the motor is stopped after the compression chamber is dried, it is supposed that the pressure exceeds set cut-out pressure before the compression chamber is fully dried, a relief valve is operated and a protective device such as a thermal relay is operated.

To avoid this situation, before the compression chamber is fully dried, the compressor is stopped. According to research by these inventors, drying operation for approximately one minute is required to dry the compression chamber, while in a case that compressed fluid is air, in the combination of a compressor currently normally used and an air vessel (the air vessel of approximately 0.1 to 0.2 $m^3$ for the compressor the discharge of which is 1 $m^3$/min. in the conversion of a sucked state), sufficient drying time cannot be secured.

Then, energy saving operation according to a usage rate of air is enabled by using the variable frequency drive, controlling so that the rotating speed of the motor is reduced and the compressor is not stopped as much as possible when the usage rate of compressed fluid, that is, a load factor of the compressor is small.

Besides, to more effectively stop the compressor in a dry condition, water injection may be also stopped to be operation without water injection when the rotating speed of the motor is reduced to some extent.

In the above, unload operation can be also used together. For example, a check valve or a minimum pressure valve is provided on the way of a discharge piping to be a path of air in the compressor and the operation (hereinafter called unload operation without water injection) is continued, emitting air on the primary side (the upstream side) of the check valve or the minimum pressure valve into the atmosphere after water injection into the compressing path is stopped during the operation.

Hereby, operation without water injection is enabled without operating the above-mentioned protective device, when a compressed air flow rate is increased during the operation without water injection, the supply of compressed air can be resumed by stopping the emission of air, and when a flow rate of compressed air is further increased, the injection of water into the compression chamber can be also resumed.

Further, more suitable control is enabled by providing a suction throttle valve on the suction side of the compressor. The reason is that the pressure of the compression chamber is turned negative by closing the suction throttle valve during operation without water injection before the compressor is stopped and the compression chamber can be dried faster. When the emission of air is executed while the suction throttle valve is closed, the compression ratio decreases, the power decreases, and the rise of discharge temperature can be reduced.

In the above configuration and control, blow-off air may include moisture. Then, the periphery of the compressor can be protected by utilizing a water separator before the emission.

It is desirable that pressure for operation without water injection to be initiated is set to cut-out pressure as control pressure or to lower pressure than the cut-out pressure.

In the above, in capacity control, that is, in an automatic stop according to line pressure, the injection of water and a stop of the motor are simultaneously executed and if operation without water injection is executed only in a stop not necessarily linked with the variation of line pressure such as a stop according to a stop instruction from the field where compressed air is used, a stop instruction depending upon multi unit control and a stop instruction depending upon scheduled operation, more energy can be saved.

In the scroll air compressor in this example, to correspond to two operating conditions (operation with water injection and operation without water injection), an aftercooler is installed between an air end of the scroll air compressor and a water separator tank, it is desirable that in the operation without water injection, compressed air is cooled by the aftercooler so that the temperature (approximately 200° C.) goes down to temperature below 100° C., and this configuration characterizes this example.

According to this configuration, the decrease by evaporation of injected water left in the water separator tank arranged on the secondary side (the downstream side) of the aftercooler and the rapid rise by the evaporation of the injected water of pressure in the water separator tank are prevented, and stable operation is enabled. In operation with water injection, fluid in which injected water of minimum quantity for the quantity of sucked air and compressed air are mixed is effectively cooled in the aftercooler and the operation with water injection is enabled. This example is configuration specific to a scroll air compressor which requires only extremely small quantity of injected water.

Referring to the drawings, the concrete example of the present subject matter will be described below.

Figure 2:
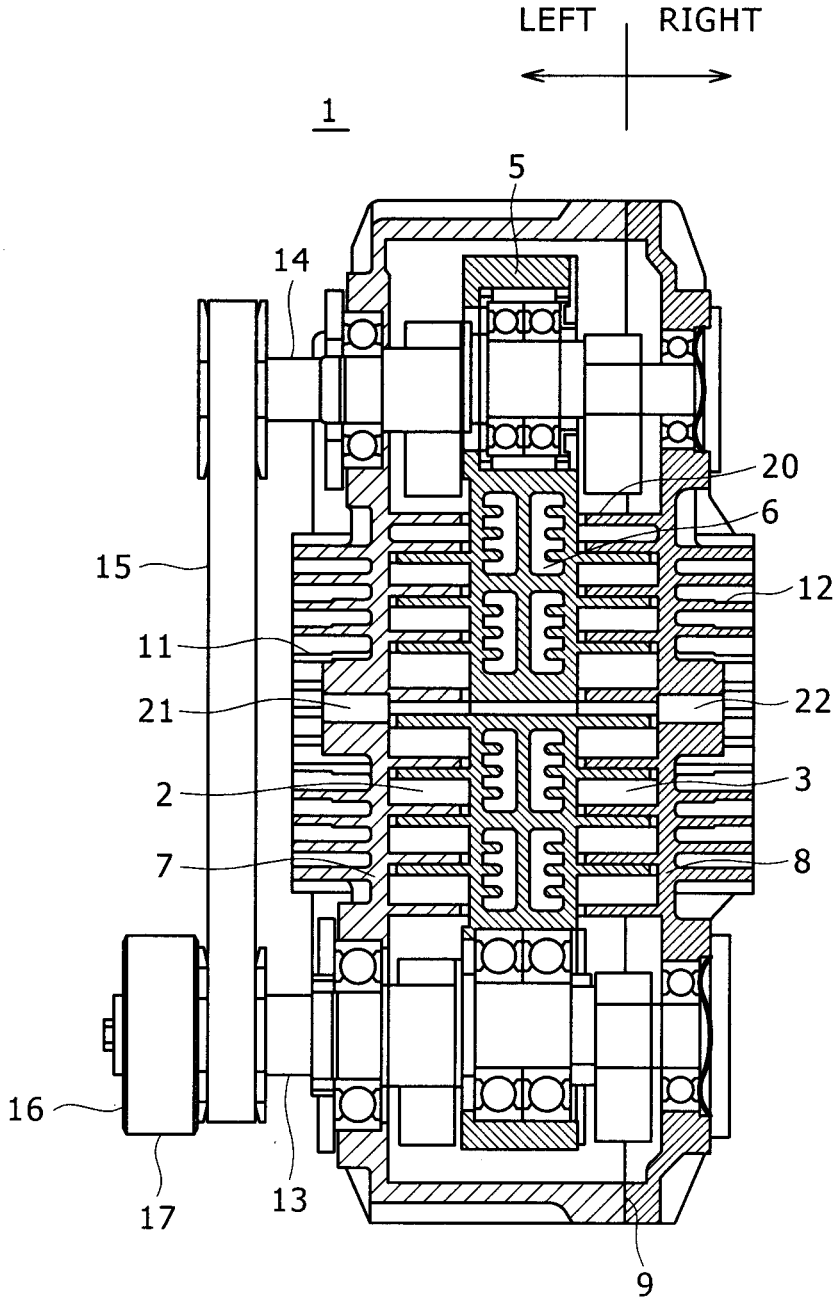
FIG. 2 is a top sectional view showing the scroll air compressor in the example of the present subject matter.
Figure 3:
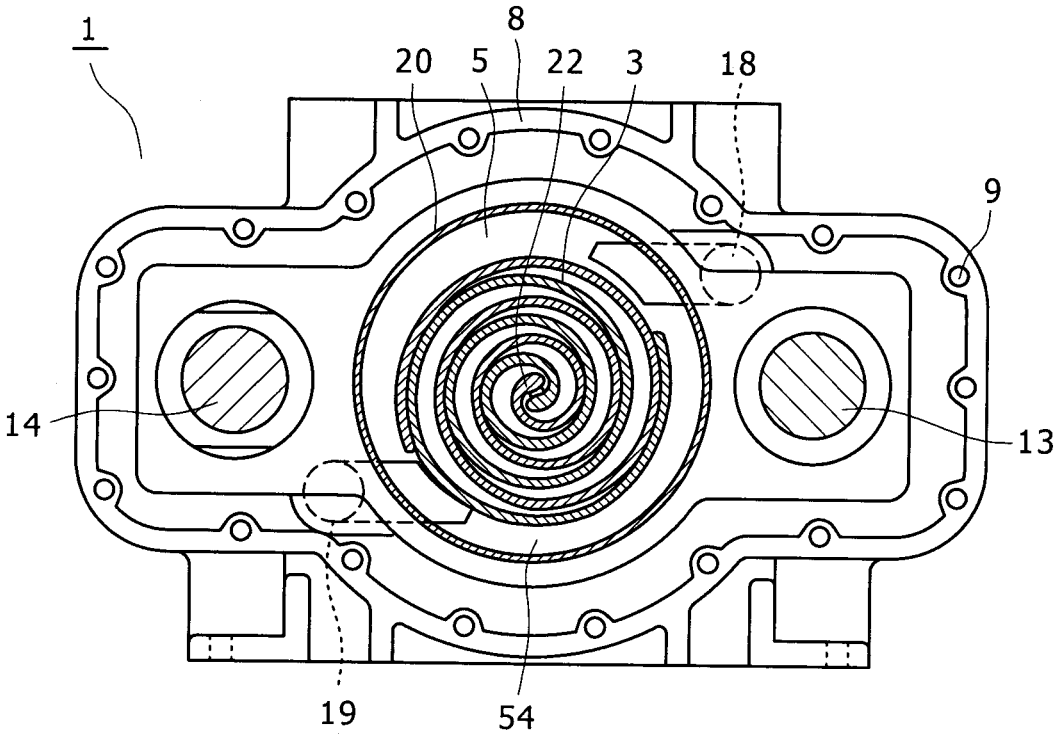
FIG. 3 is a side sectional view showing the scroll air compressor in the example of the present subject matter.

FIG. 1 is a system diagram showing the whole configuration of the water injected scroll air compressor in this example and shows the example of the present subject matter. FIG. 2 is a top view sectional view showing the air end, and FIG. 3 is a side sectional view showing the air end.

Before the whole configuration is described, the structure of the air end 1 of the scroll air compressor will be described referring to FIGS. 2 and 3.

The air end 1 of the scroll air compressor is provided with two left and right scroll mechanisms 2, 3 and each scroll mechanism is configured by wrap on the orbiting side, a wrap on the fixed side and end plates equivalent to bottoms of the wraps. The two left and right wraps on the orbiting side are formed back to back with the same orbiting scroll 5 and a through hole 6 for passing cooling air is provided in the center of the orbiting scroll 5 held between the end plates of both wraps.

The wrap on the fixed side engaged with the wrap of the orbiting scroll 5 is formed inside the left fixed scroll 7 and inside the right fixed scroll 8 and these two left and right fixed scrolls are connected by bolts in a peripheral connecting part 9 to be a casing of the air end 1. Each cooling fin 11, 12 is formed on a surface to be just the reverse surface to the wrap provided inside each fixed scroll 7, 8.

The orbiting scroll 5 is supported by eccentric parts of a main shaft 13 and a countershaft 14 via bearings outside the wrap. The eccentricity of the two shafts is the same and a link mechanism configured by four parallel rods is formed. The main shaft 13 and the countershaft 14 are supported by the casing via the bearings and are synchronously rotated by the action of a timing belt 15 wound onto a pulley for synchronization provided at an end of the casing. For the driving unit in this example, the motor 100 (see FIG. 1) is used and the main shaft 13 receives power from an output shaft of the motor 100 via a belt 17 wound onto a pulley for driving 16.

The suction ports 18, 19 that pierce a wall are provided just outside the wrap of each fixed scroll 7, 8. As the two suction ports are arranged on one side, the total four suction ports are provided. A passage that connects with the inside of the casing through the suction ports 18, 19 from the outside continues to the inside of a dust seal 20 and connects with a peripheral room 54 encircling the wraps. The dust seal 20 is attached to an end of a cylindrical wall that overhangs inside each left/right fixed scroll 7, 8 and encircles the wrap and is slid in the vicinity of the periphery of the end plate of the orbiting scroll 5. The dust seal 20 is provided to prevent a foreign matter from invading in the compression chamber.

A discharge port 21, 22 that pierces the fixed scroll 7, 8 and connects the compression chamber at a final stage and the outside is provided in the center of each left/right wrap. To balance the left and right compression chamber, a pipe line that pierces the center of the orbiting scroll 5 for making the two discharge ports 21, 22 communicate is provided.

According to the above-mentioned configuration, the orbiting scroll 5 is orbited by the motor 100 and air sucked from the suction ports 18, 19 is compressed in the scroll mechanisms 2, 3. The compressed air is discharged from the discharge ports 21, 22 and is supplied outside via a passage described later.

Referring to FIG. 1, the configuration and the action of the present subject matter will be described below.

The air end 1 has configuration in which the scroll members equipped with each scroll wrap are combined and for example, has structure that water can be injected into the compression chamber together with air sucked from the suction port.

The air end 1 is configured via optimum clearance so that the operation is enabled without water injection and further, efficient operation with water injection is enabled with minimum quantity of injected water for the quantity of sucked air.

In FIG. 1, the discharge piping of compressed air (or fluid mixed with injected water) is shown by a full line and the piping of injected water is shown by a broken line. As shown in FIG. 1, the tank (105) for storing water separated from compressed air is provided on a path of the discharge piping and the cooler (104) is arranged between the tank (105) and the air end 1 on the path of the discharge piping. The cooler (called the aftercooler) cools air discharged from the air end 1 in operation without water injection and cools mixed fluid of air and water respectively discharged from the air end 1 in operation with water injection. Accordingly, on the downstream side of the aftercooler 104, the cooled mixed fluid of air and water is separated.

The separated water is stored in the tank, however, in this example, the separator tank also provided with a water separating function is provided. Hereby, the separation and the storage of water are enabled with simple configuration.

A flow of compressed fluid is as follows.

A suction filter 101 is provided on the suction side of the air end 1 and the suction throttle valve 102 for adjusting capacity may be also provided on the secondary side (the downstream side) of the suction filter.

In operation with water injection, after the mixed fluid of air compressed in the air end 1 and injected water passes the check valve 103 on the body side and is cooled in the aftercooler 104, it flows into the water separator tank 105. In the water separator tank 105, the mixed fluid is separated into the injected water and the compressed air, the injected water is collected in the water separator tank 105, the compressed air passes a minimum pressure valve 106, and depending upon a required specification of a dew point, the compressed air passes a drier 117 and is discharged.

The air end 1 used in this example is provided with a water injected mechanism in which high efficiency is acquired with injected water of minimum quantity for the quantity of sucked air, as only small quantity of water is injected, a special water cooler for cooling injected water the temperature of which rises because of the heat of compression is not required to be provided, and the injected water can be cooled in the aftercooler 104 for cooling compressed air together with the compressed air.

In operation without water injection, the temperature of fluid discharged from the air end 1 exceeds a boiling point of water under atmospheric pressure and reaches approximately 200° C., however, water remaining in the water separator tank 105 arranged on the secondary side of the aftercooler 104 can be prevented from reaching temperature equal to or higher than the boiling point and from being evaporated by arranging the aftercooler 104 between the air end 1 and the water separator tank 105 and cooling the fluid so that the temperature of the fluid at an exit of the aftercooler 104 is below 100° C. equal to or lower than the boiling point of water under atmospheric pressure, and at the same time, the rapid rise of pressure in the water separator tank 105 by the evaporation of the remaining water can be prevented.

A flow of water injected into the air end 1 is as follows.

Water is injected into the air end 1 by opening a water injection control valve 107 controlled so that high efficiency is acquired with injected water of minimum quantity for the quantity of sucked air. The injected water passes the check valve 103 on the body side together with compressed fluid, is cooled in the aftercooler 104, and is separated in the water separator tank 105. The separated moisture is purified in a strainer 108 and a water filter 109 and is injected into the air end 1 again according to a degree of an opening of the water injection control valve 107.

In a driving system, the driving force of the motor 100 drives the air end 1 via a belt 17. In a control panel 113, the variable frequency drive 122 may be also built and hereby, the rotating speed of the motor 100 can be adjusted.

As for an air blow off line, at least either of the following first or second one has only to be provided or no air blow off line may be also provided.

The first air blow off line is provided on the secondary side (the downstream side) of the air end 1, compressed high-temperature fluid passes a water separator 114 after it is cooled utilizing exhaust from the aftercooler 104 and others because the compressed high-temperature fluid is blown, and is blown from an air blow off solenoid valve 115.

The second air blow off line is provided on the secondary side of the water separator tank 105 and after the compressed air passes a water separator 124, it is blown by an air blow off solenoid valve 125. When the air blow off line is provided on the secondary side (the downstream side) of the water separator tank 105, no aftercooler check valve 116 is required.

The air blow off line may be also provided between the aftercooler 104 and the water separator tank 105.

The control system is configured as follows.

When the variable frequency drive 122 is provided, the rotating speed of the motor 100 can be controlled. In the control panel 113, an arithmetic unit 123 to which signals from pressure sensors 118, 119 and temperature sensors 120, 121 are input and which can operate operation time, stop time, the rotating speed of the motor 100 instructed from the variable frequency drive 122 and others is built, the arithmetic unit operates these, and can adjust the activation and the stop of the motor 100, the opening and the closing of the suction throttle valve 102, the opening and the closing of the air blow off solenoid valves 115, 125, the opening of the water injection control valve 107 and the rotating speed of the motor 100 instructed from the variable frequency drive 122. The pressure sensors 118, 119 and the temperature sensors 120, 121 may be also pressure switches and temperature switches.

According to this example, two operations of operation with water injection and operation without water injection are enabled with one compressor, problems such as corrosion, the failure of the activation and the touch of the wraps respectively caused by water when the water is injected into the compressor are avoided by suitably executing operation without water injection, and the longtime stable operation can be maintained.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A water injected air compressor, comprising:

an air end provided with an orbiting member equipped with an orbiting element and a fixed member equipped with a substantial fixed element corresponding to the orbiting element of the orbiting member;

a driving unit that generates driving force for making the orbiting member orbit the fixed member;

a compressing path from a suction port to a discharge port;

a portion to inject water into the compressing path;

discharge piping for air discharged from the air end;

a tank provided on a path of the discharge piping for storing water separated from compressed air; and a cooler that is provided on the path of the discharge piping between the tank and the air end and that cools the compressed air discharged from the air end to below 100° C.;

wherein compressor operation is controlled by switching between a first operation in which water is injected into the compressing path and a second operation in which no water is injected.

2. The water injected air compressor according to claim 1, wherein the cooler cools air discharged from the air end in the second operation, and cools a mixed fluid of air and water discharged from the air end in the first operation.

3. The water injected air compressor according to claim 2, wherein the mixed fluid of air and water is separated on a downstream side of the cooler.

4. The water injected air compressor according to claim 3, wherein the tank is a separator tank that can separate air and water.

5. The water injected air compressor according to claim 1, wherein:

the air end is provided with a total of two compressing mechanisms, each of which is configured by an orbiting member and a fixed member;

the elements of the orbiting members of both compressing mechanisms are formed back to back with the same member;

the orbiting member is driven by two eccentric shafts provided outside a periphery of the elements of the orbiting members and synchronously rotated;

the eccentric shafts are substantially horizontally arranged; and against thermic deformation and deformation by gas pressure in operation without water injection, clearance is formed between the elements of the orbiting member and the fixed member to prevent the elements from being mutually touched.

6. The water injected air compressor according to claim 1, wherein the orbiting member and the fixed member are made of at least one aluminum alloy.

7. A water injected scroll air compressor, comprising:

an air end provided with an orbiting scroll member equipped with a scroll wrap and a fixed scroll member equipped with a substantial scroll wrap corresponding to the scroll wrap of the orbiting scroll member;

a driving unit that generates driving force for making the orbiting scroll member orbit the fixed scroll member;

a compressing path from a suction port to a discharge port;

a portion to inject water into the compressing path;

discharge piping for air discharged from the air end;

a tank provided on a path of the discharge piping for storing water separated from compressed air; and a cooler that is provided on the path of the discharge piping between the tank and the air end and that cools the compressed air discharged from the air end to below 100° C.;

wherein compressor operation is controlled by switching between a first operation in which water is injected into the compressing path and a second operation in which no water is injected.

8. The water injected scroll air compressor according to claim 7, wherein the cooler cools air discharged from the air end in the second operation, and cools a mixed fluid of air and water discharged from the air end in the first operation.

9. The water injected scroll air compressor according to claim 8, wherein the mixed fluid of air and water is separated on a downstream side of the cooler.

10. The water injected scroll air compressor according to claim 9, wherein the tank is a separator tank that can separate air and water.

11. The water injected scroll air compressor according to claim 7, wherein:

the air end is provided with a total of two compressing mechanisms, each of which is configured by an orbiting scroll member and a fixed scroll member;

the scroll wraps of the orbiting scroll members of both compressing mechanisms are formed back to back with the same member;

the orbiting scroll member is driven by two eccentric shafts provided outside a periphery of the wrap and synchronously rotated;

the eccentric shafts are substantially horizontally arranged; and against thermic deformation and deformation by gas pressure in operation without water injection, clearance is formed between the wraps of the orbiting scroll member and the fixed scroll member to prevent the wraps from being mutually touched.

12. The water injected scroll air compressor according to claim 7, wherein the orbiting scroll member and the fixed scroll member are made of at least one aluminum alloy.

* * * * *